US009384931B2

(12) United States Patent
Fasano

(10) Patent No.: US 9,384,931 B2
(45) Date of Patent: Jul. 5, 2016

(54) REMOTE OPERATED CIRCUIT BREAKER

(71) Applicant: Michael Fasano, Watertown, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 14/457,860

(22) Filed: Aug. 12, 2014

(65) Prior Publication Data

US 2014/0354380 A1 Dec. 4, 2014

Related U.S. Application Data

(63) Continuation of application No. 13/598,217, filed on Aug. 29, 2012, now Pat. No. 8,803,640.

(51) Int. Cl.

| | |
|---|---|
| ***H01H 75/00*** | (2006.01) |
| ***H01H 77/00*** | (2006.01) |
| ***H01H 89/00*** | (2006.01) |
| ***H01H 71/24*** | (2006.01) |
| ***H01H 89/08*** | (2006.01) |
| ***H01H 3/38*** | (2006.01) |
| ***H01H 3/46*** | (2006.01) |
| ***H01H 21/22*** | (2006.01) |
| ***H01H 71/32*** | (2006.01) |
| *H01H 71/52* | (2006.01) |
| *H01H 83/20* | (2006.01) |

(52) U.S. Cl.

CPC ..... *H01H 89/00* (2013.01); *H01H 3/38* (2013.01); *H01H 3/46* (2013.01); *H01H 21/22* (2013.01); *H01H 71/24* (2013.01); *H01H 71/2463* (2013.01); *H01H 71/32* (2013.01); *H01H 89/08* (2013.01); *H01H 71/525* (2013.01); *H01H 2083/203* (2013.01)

(58) Field of Classification Search

CPC ..... H01H 71/528

See application file for complete search history.

(56) References Cited

U.S. PATENT DOCUMENTS

| | | | | | |
|---|---|---|---|---|---|
| 3,305,806 | A | * | 2/1967 | Norden | 335/174 |
| 3,495,198 | A | * | 2/1970 | Giger, Jr. | 335/16 |
| 4,423,400 | A | * | 12/1983 | Marcoz | 337/72 |
| 4,529,951 | A | * | 7/1985 | Youichi et al. | 335/13 |
| 4,532,486 | A | * | 7/1985 | Terrier | 335/13 |
| 4,604,596 | A | * | 8/1986 | Yokoyama et al. | 335/14 |
| 4,636,760 | A | * | 1/1987 | Lee | 335/14 |
| 4,725,799 | A | * | 2/1988 | Bratkowski et al. | 335/14 |
| RE32,882 | E | * | 3/1989 | Yokoyama et al. | 335/14 |
| RE33,325 | E | | 9/1990 | Yokoyama et al. | |
| 4,982,174 | A | * | 1/1991 | Fasano | 335/201 |
| 5,053,735 | A | * | 10/1991 | Ohishi et al. | 335/14 |

(Continued)

FOREIGN PATENT DOCUMENTS

| | | | |
|---|---|---|---|
| DE | 3634456 | C1 | 2/1988 |
| DE | 102010019353 | B3 | 11/2011 |

(Continued)

*Primary Examiner* — Alexander Talpalatski

(74) *Attorney, Agent, or Firm* — St. Onge Steward Johnston & Reens, LLC

(57) ABSTRACT

A circuit breaker having a movable contact arm for opening and closing the circuit which is controlled separately by a circuit breaker mechanism for circuit protection and by a switch lever mechanism which does not require actuation of the circuit breaker mechanism to function. The switch lever may be activated by a solenoid or other suitable means, and various interlocking mechanical states exist among the elements that provide added safety features.

16 Claims, 5 Drawing Sheets

(56) References Cited

U.S. PATENT DOCUMENTS

| | | | | | |
|---|---|---|---|---|---|
| 5,079,529 | A * | 1/1992 | Ohishi et al. | 335/14 |
| 5,164,693 | A * | 11/1992 | Yokoyama et al. | 335/14 |
| 5,886,604 | A * | 3/1999 | Kume | 335/172 |
| 5,886,605 | A * | 3/1999 | Ulerich et al. | 335/172 |
| 6,414,575 | B1 * | 7/2002 | Swift | 335/6 |
| 6,538,539 | B1 * | 3/2003 | Lu | 335/6 |
| 6,801,109 | B2 * | 10/2004 | Simms | 335/14 |
| 2006/0244557 | A1 * | 11/2006 | Sorenson | 335/172 |

FOREIGN PATENT DOCUMENTS

| | | | |
|---|---|---|---|
| EP | 0236576 | A1 | 9/1987 |
| FR | 2577071 | A1 | 8/1986 |
| GB | 2172146 | A | 9/1986 |
| JP | H02109232 | A | 4/1990 |
| JP | H04101320 | A | 4/1992 |
| JP | H0567425 | A | 3/1993 |
| JP | H0614451 | B2 | 2/1994 |
| KR | 920003959 | B1 | 5/1992 |

* cited by examiner

| State | Mechanism | Lever | Contact Position | Current Flow | Toggle M | Toggle L |
|---|---|---|---|---|---|---|
| A | 1 | 1 | Closed | ON | D | C |
| B | 0 | 0 | Open 1 | OFF | C | D |
| C | 1 | 0 | Open 2 | OFF | B | A |
| D | 0 | 1 | Open 1 | OFF | A | B |

FIG. 4

REMOTE OPERATED CIRCUIT BREAKER

FIELD OF THE INVENTION

The invention relates to remotely operated circuit breakers in general, and to a circuit breaker that is remotely operated using a contact arm which can be operated using a solenoid mechanism that is separate from the circuit breaker handle mechanism.

BACKGROUND OF THE INVENTION

A circuit breaker is a device that can be used to protect an electrical circuit from damage caused by an overload or a short circuit. If a power surge occurs in a circuit protected by the circuit breaker, for example, the breaker will trip. This will cause a breaker that was in the "on" position to flip to the "off" position, and will interrupt the electrical power leading from that breaker. By tripping in this way a circuit breaker can prevent a fire from starting on an overloaded circuit, and can also prevent the destruction of the device that is drawing the electricity or other devices connected to the protected circuit.

A standard circuit breaker has a line and a load. Generally, the line receives incoming electricity, most often from a power company. This is sometimes be referred to as the input into the circuit breaker. The load, sometimes referred to as the output, feeds out of the circuit breaker and connects to the electrical components being fed from the circuit breaker. A circuit breaker may protect an individual component connected directly to the circuit breaker, for example, an air conditioner, or a circuit breaker may protect multiple components, for example, household appliances connected to a power circuit which terminates at electrical outlets.

A circuit breaker can be used as an alternative to a fuse. Unlike a fuse, which operates once and then must be replaced, a circuit breaker can be reset (either manually or automatically) to resume normal operation. When the power to an area shuts down, an operator can inspect the electrical panel to see which breaker has tripped to the "off" position. The breaker can then be flipped to the "on" position and power will resume again.

In general, a circuit breaker has two contacts located inside of a housing. Typically, the first contact is stationary, and may be connected to either the line or the load. Typically, the second contact is movable with respect to the first contact, such that when the circuit breaker is in the "off", or tripped position, a gap exists between the first and second contact, and the line is disconnected from the load.

Circuit breakers are usually designed to be operated infrequently. In typical applications circuit breakers will be operated only when tripped by a power spike or other electrical disturbance. Power spikes do not regularly occur during normal operation of typical circuits.

In some applications however, it is desirable to operate circuit breakers more frequently. For example, in the interest of saving electricity it may be beneficial to control the power distribution to an entire floor of a building from one location. This can be done by manually tripping a breaker for the entire floor circuit. It may also be desirable to manually trip the circuit breaker remotely, using a remote control, timer, motion sensor, or the like.

In other applications, it is desirable to operate a circuit breaker remotely for maintenance purposes. For example, an operator may manually trip a circuit breaker to de-energize a protected circuit so that it can be inspected or serviced. However in some circuits, operating the breaker can produce a dangerous arc, creating a safety hazard for the operator. In still other circuits, the circuit breaker may be located in a confined or hazardous environment. In these situations, it is also beneficial to operate the circuit breaker remotely.

Known approaches to remotely controlling circuit breakers include incorporating a mechanism into the circuit breaker which can intentionally trip the circuit breaker mechanism and reset it. Examples of such mechanisms are solenoids or motors used to activate the trip mechanism, and solenoids or motors which are used to reset the circuit breaker by rearming the trip mechanism.

However, using a circuit breaker as a power switch or remote control in this way subjects the breaker to a far greater number of operational cycles than it would otherwise experience in a typical circuit protection application. This can result in an unacceptably premature failure of the circuit breaker. Typical circuit breaker mechanisms are designed to survive only 20,000-30,000 cycles before failure.

In order to increase the number of cycles that such circuit breakers can endure before failure, all of the components of the circuit breaker, including the tripping mechanism and any springs, linkages, escapements, sears, dashpots, bimetal thermal components, or other components that are part of the mechanism must be designed in a more robust way than would otherwise be required. This increases the cost of producing the circuit breaker considerably.

What is desired therefore, is a circuit breaker that can be remotely or manually activated which addresses these limitations.

SUMMARY OF THE INVENTION

Accordingly, it is an object of the present invention to provide a circuit breaker which can be turned on and off remotely.

It is another object of the present invention to provide a circuit breaker which can be turned on and off using a mechanism that is discrete from the circuit breaker mechanism.

These and other objects are achieved by providing a circuit breaker which includes a first contact; a second contact which is moveable between a closed position relative to the first contact and an open position relative to the first contact, and which is disposed to contact the first contact only in the closed position; a circuit breaker mechanism having a tripped state and an untripped state, which is disposed to change the position of the contacts when the circuit breaker mechanism changes state and; an actuator having an on state and an off state, which is disposed to change the position of the contacts without changing the state of the circuit breaker mechanism when the actuator changes state.

In some embodiments, if the circuit breaker mechanism is in the tripped state, the contacts are in the open position.

In some embodiments, if the circuit breaker mechanism is in the tripped state, the contacts cannot move to the closed position.

In some embodiments, if the actuator is in the off state, the contacts are in the open position.

In some embodiments, if the actuator is in the off state, the circuit breaker mechanism cannot move the contacts into the closed position.

In some embodiments, the actuator is disposed to change the state of the lever in response to a signal.

In some embodiments, the circuit breaker mechanism is disposed to move the contacts from the closed position to the open position in response to an overcurrent condition.

In some embodiments, the circuit breaker mechanism is disposed to move the contacts from the closed position to the open position in response to a manual operation.

In some embodiments, the actuator moves the contacts between the closed position and the open position using a lever.

In some embodiments, the actuator is a solenoid.

In some embodiments, the contacts are biased using a spring.

In some embodiments, the contacts are biased using a permanent magnet.

In some embodiments, the solenoid comprises a permanent magnet disposed to bias the contacts.

In some embodiments, the permanent magnet is disposed to bias the contacts when the solenoid is de-energized.

In some embodiments, the solenoid comprises a permanent magnet disposed to move the contacts to the open position when the solenoid is de-energized.

In some embodiments, the circuit breaker mechanism comprises an escapement.

In some embodiments, the circuit breaker mechanism comprises a dashpot.

In some embodiments, the circuit breaker mechanism is separate from the actuator.

Other objects of the invention are achieved by providing a circuit breaker which includes contacts relatively moveable between an open position and a closed position; a circuit breaker mechanism disposed to change the position of the contacts when the circuit breaker is actuated; and a switching mechanism disposed to open and close the contacts without actuating the circuit breaker mechanism.

Further objects of the invention are achieved by providing a circuit breaker which includes a first contact; a movable member having a closed position and an open position; a second contact on the movable member disposed to contact the first contact only when the movable member is in the closed position; a circuit breaker mechanism having a tripped state and an untripped state, which is connected to the movable member and disposed to move the moveable member when the circuit breaker mechanism changes state; a solenoid having an on state and an off state, which is connected to the movable member and disposed to move the moveable member without changing the state of the circuit breaker mechanism when the solenoid changes state; and, a permanent magnet biasing the solenoid to the off state.

Still other objects of the invention and its particular features and advantages will become more apparent from consideration of the following drawings and accompanying detailed description.

BRIEF DESCRIPTION OF THE DRAWINGS

FIG. 4 is a table reflecting various combinations of positions of the elements of the example circuit breaker shown in FIGS. 1-3 according to aspects of the invention.

DETAILED DESCRIPTION OF THE INVENTION

Figure 1:
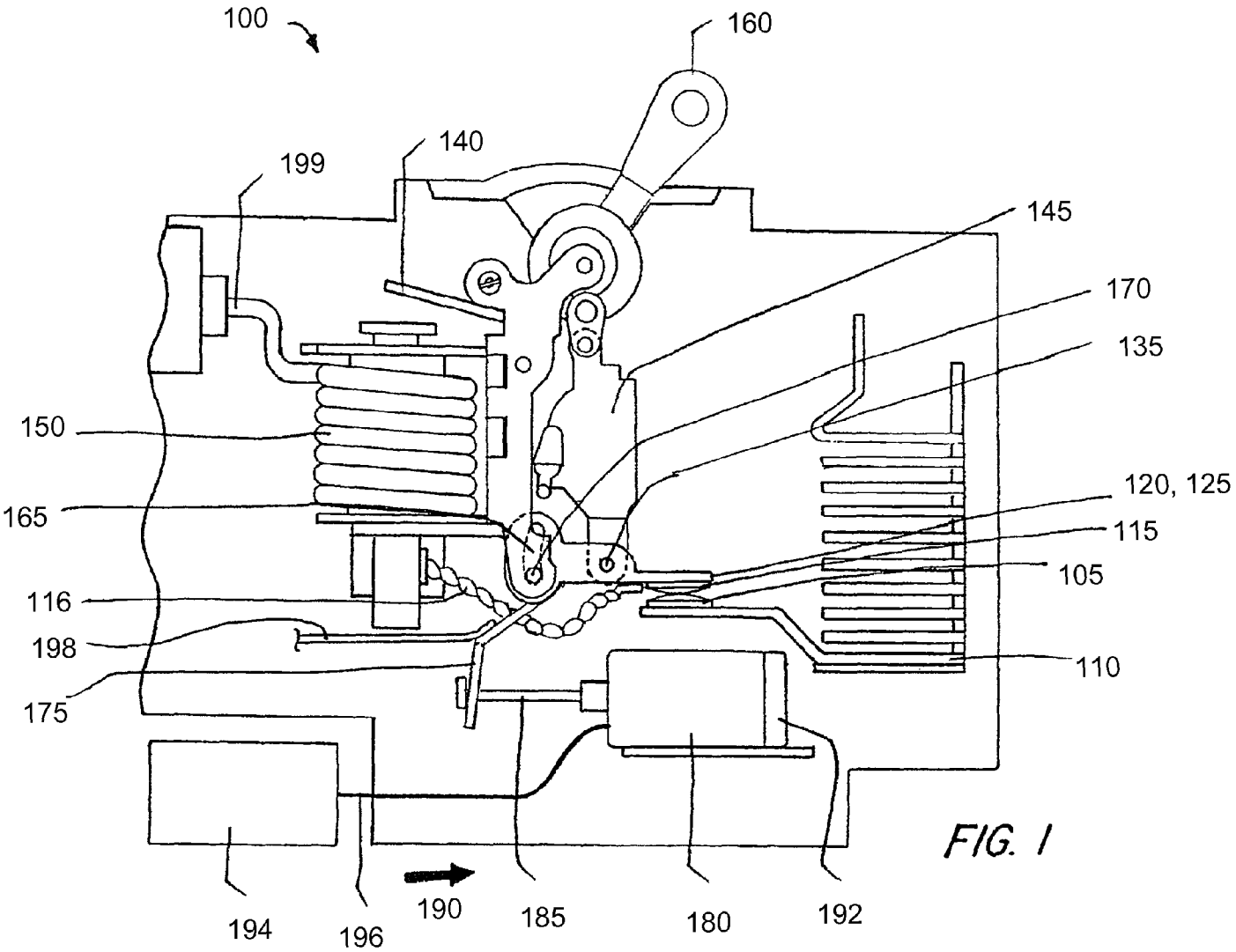
FIG. 1 is a side view of an example circuit breaker according to aspects of the invention, showing a closed position.

FIG. 1 illustrates an example circuit breaker 100 according to aspects of the invention.

Circuit breaker 100 includes a stationary contact 105 connected to a line terminal 110. The line terminal receives electricity from a power source such as a generator (not shown), which in some applications is supplied by a power company.

A movable contact 115 is disposed on a movable contact arm 120 which can be moved between a closed position 125 and open positions 200 and 300 (FIGS. 2 and 3) by pivoting on a first pivot 135 and second pivot 170.

The movable contact arm 120 is connected to a tripping mechanism 140 by a linkage 145. As shown, tripping mechanism 140 is in an untripped state. The linkage may include a spring mechanism (not shown), which is biased to move the movable contact arm from the closed position to the open position when tripping mechanism 140 is tripped.

A fault detector 150 is connected to the movable terminal and is configured to activate the tripping mechanism 140 when a fault condition occurs, such as excess current. In some applications, the fault detector is a solenoid which is disposed inline with the circuit. If the current through the solenoid exceeds a certain level, the solenoid generates an electromagnetic field sufficient to activate the tripping mechanism. The solenoid may also optionally incorporate a plunger or other armature which activates the tripping mechanism when the current exceeds a certain level.

It is understood that other fault detection methods may also be employed, which trip the tripping mechanism upon the occurrence of a specific condition.

Movable contact 115 is connected to load terminal 199 through fault detector 150 and connector 116. When movable contact 115 is in a closed position, as shown in FIG. 1, stationary contact 105 and moveable contact 115 are in contact with each other, and electricity can flow from line terminal 110 to load terminal 199 through contacts 105 and 115.

A handle 160 is also provided for resetting the tripping mechanism 140, or for manually tripping the tripping mechanism 140.

The moveable contact arm 120 includes a guide channel 165 which allows moveable contact arm 120 to slide and/or pivot around second pivot point 170. Moveable contact arm 120 also includes a lever 175. The lever may be formed in one piece with the movable contact arm 120, or may be a separate piece that is attached to the movable contact arm 120.

Actuator solenoid 180 has a plunger 185 which is connected to lever 175. The lever 175, movable contact arm 120, and guide channel 165 are disposed such that when tripping mechanism 140 is in an untripped condition, as shown, and actuator solenoid 180 is activated, plunger 185 moves in the direction of arrow 190, moving movable contact arm 120 from closed position 125 to a second open position (200, FIG. 2) by pivoting movable contact arm 120 around pivot point 135 and sliding guide channel 165 along second pivot point 170.

Incorporating an actuator such as actuator solenoid 180 to open and close contacts 105 and 115 in this way can have the advantage of allowing the number of manual operational cycles of the circuit breaker to be increased without incurring the additional costs associated with increasing the robustness of trip mechanism 140 and its associated components, as they are not actuated when the contacts are opened via the actuator solenoid. In this way, operational life can be increased to approximately 200,000 cycles in a typical application.

Actuator solenoid 180 may be activated using a remote signal. Actuator solenoid 180 may be a bistable or latching solenoid, incorporating a permanent magnet 192. In this case, plunger 185 will hold its position unless actuator solenoid 180 is energized with the correct polarity.

A polarity switch 194 may be connected to actuator solenoid 180 using connector 196. Polarity switch 194 can provide a pulse signal of either polarity to actuator solenoid 180 in order to extend or retract plunger 185. When no signal is present, plunger 185 is held in place by solenoid 180.

Figure 2:
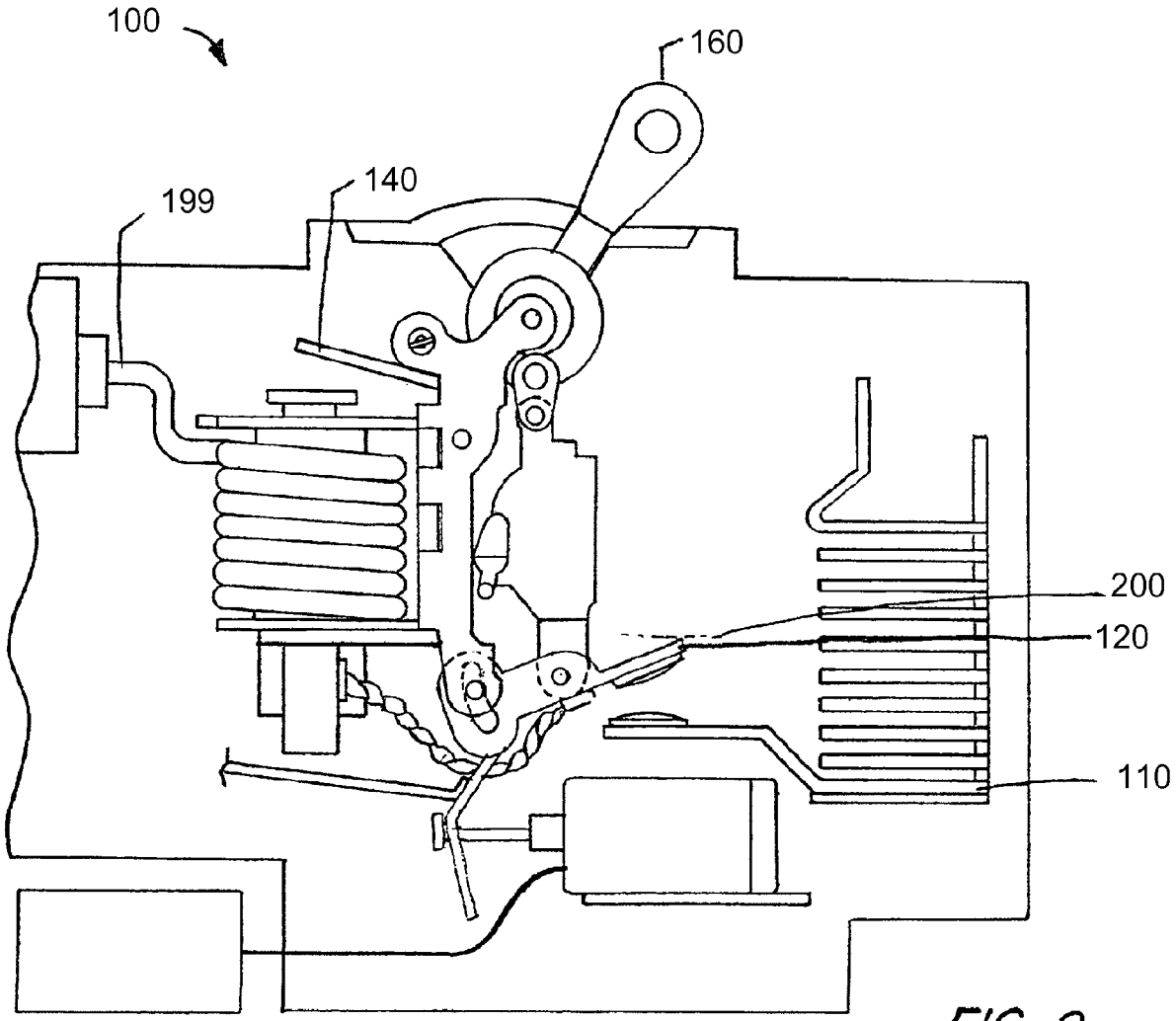
FIG. 2 is another side view of the example circuit breaker shown in FIG. 1, showing a remotely opened position.

Permanent magnet 192 may also be disposed such that when actuator solenoid 180 is de-energized, plunger 185 is drawn in the direction of arrow 190, opening the circuit by moving movable contact 115 from closed position 125 to second open position (200, FIG. 2).

A biasing spring 198 may optionally be disposed to bias lever 175 such that plunger 185 only needs to provide force in one direction.

FIG. 2 illustrates example circuit breaker 100 in a state where as in FIG. 1, the tripping mechanism 140 is untripped, but where movable contact arm 120 is in a second open position 200.

Figure 3:
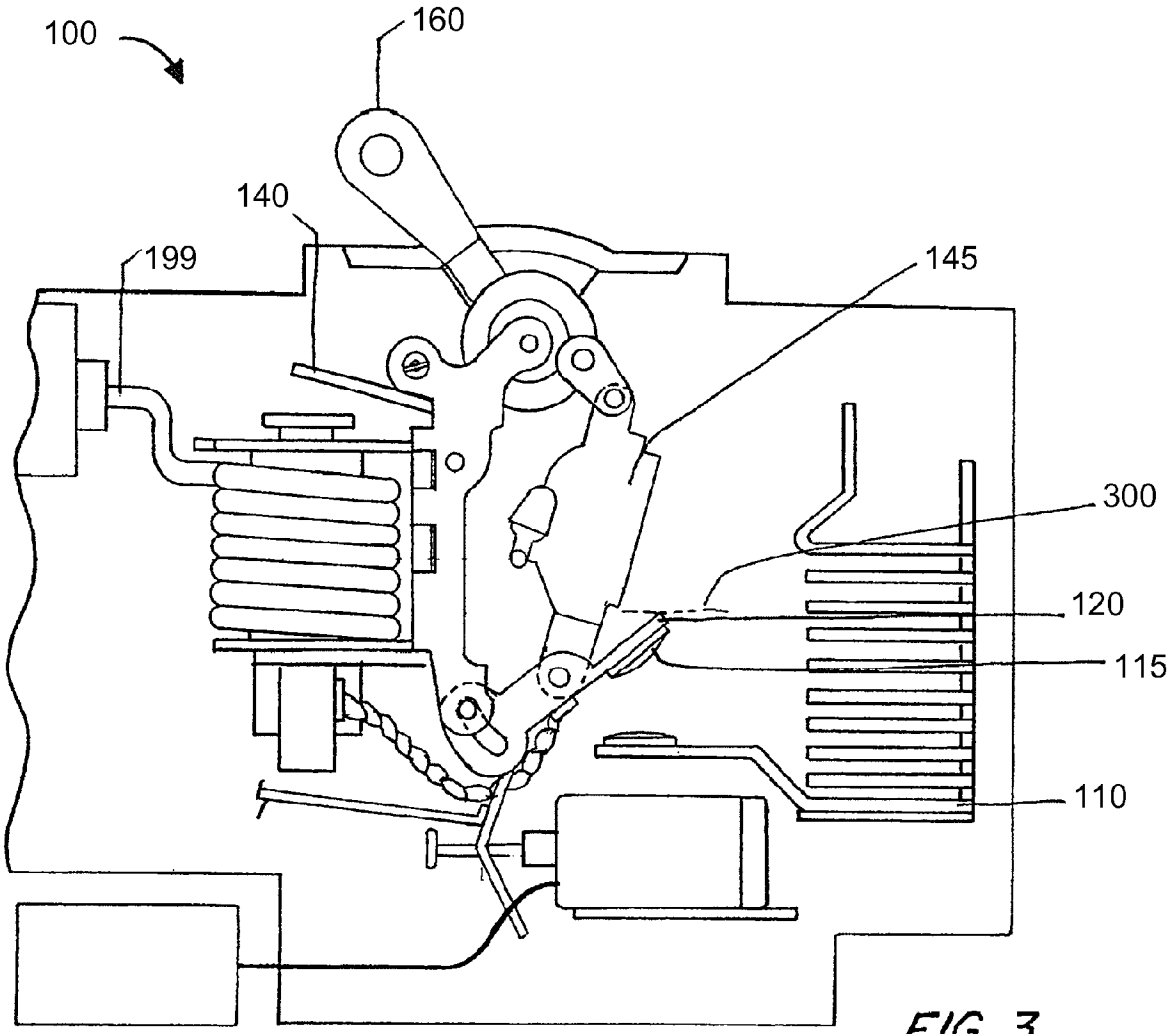
FIG. 3 is another side view of an example circuit breaker shown in FIGS. 1 and 2, showing a tripped position.

FIG. 3 illustrates example circuit breaker 100 in a state where tripping mechanism 140 is tripped. Here, movable contact lever 120 has been moved by tripping mechanism 140 via linkage 145 such that movable contact 115 is held at open position 300. With tripping mechanism 140 in a tripped state, movable contact 115 cannot return to a closed state with stationary contact 105 regardless of the position of plunger 185. This means that it is impossible to re-engage the circuit breaker after a fault using a remote system via actuator solenoid 180.

When the tripping mechanism 140 is in an untripped state as shown in FIGS. 1 and 2, contacts 115 and 105 may be freely opened and closed by actuating solenoid 180. However, when the tripping mechanism 140 is in a tripped state, contacts 115 and 105 cannot be brought back into a closed state by actuating solenoid 180. This can have the advantage of increasing safety by allowing an operator who is directly in the presence of circuit breaker 100 to override any attempts to re-close the breaker remotely or automatically which would result in a hazardous condition.

Similarly, if power to polarity switch 194 is lost preventing actuation of actuation solenoid 180 while it is in the extended position, it remains possible to open contacts 115 and 105 using tripping mechanism 140 or handle 160, and to close contacts 115 and 105 using handle 160. However, if power to polarity switch 194 is lost preventing actuation of actuation solenoid 180 while it is in the retracted position, it is impossible to re-close the contacts using handle 160. This can have the advantage of increasing safety by preventing any attempts to re-close the breaker by operating handle 160 that would result in a hazardous condition. In some applications, an additional mechanism (not shown) may be incorporated to allow plunger 185 of actuation solenoid 180 to be moved to the extended position without requiring power to polarity switch 194.

FIG. 4 is a table illustrating the various combinations of circuit breaker positions possible according to an example embodiment of the invention.

When both the circuit breaker mechanism 140 and the lever 175 are in the on position (State A), the movable contact arm is in the closed position, and current can flow through the circuit breaker 100.

From State A, if the circuit breaker mechanism 140 is toggled, e.g. by tripping the circuit breaker mechanism 140 manually or via an overcurrent condition, the moveable contact arm 120 moves to the first open position 300, and current can no longer flow through the circuit breaker 100.

From State A, if the lever 175 is toggled, e.g. by remotely activating an actuation solenoid, the moveable contact arm 120 moves to the second open position, and current can no longer flow through the circuit breaker 100.

When both the circuit breaker mechanism 140 and the lever 175 are in the off position (State B), the contact arm is in the first open position 300, and current cannot flow through the circuit breaker 100.

From State B, if the circuit breaker mechanism 140 is toggled, e.g. by resetting the circuit breaker mechanism, the movable contact arm 120 moves to the second open position, and current still cannot flow through the circuit breaker 100. This can have the advantage of enabling a remote operator to prevent current flow even if a local operator were to reset the circuit breaker, for example, when a safety hazard is known to the remote operator.

From State B, if the lever 175 is toggled, e.g. by remotely activating an actuation solenoid, the moveable contact arm 120 moves to the first open position 300, and current still cannot flow through the circuit breaker 100. This can have the advantage of enabling a local operator to prevent current flow even if a remote operator attempts to switch on the breaker, for example, when a safety hazard is known to the local operator.

When the circuit breaker mechanism 140 is in the on position and the lever 175 is in the off position (State C), the movable contact arm is in the second open position, and current cannot flow through the circuit breaker.

From State C, if the circuit breaker mechanism 140 is toggled, e.g. by tripping the circuit breaker mechanism 140 manually or via an overcurrent condition, the moveable contact arm 120 moves to the first open position 300, and current still cannot flow through the circuit breaker 100.

From State C, if the lever 175 is toggled, e.g. by remotely activating an actuation solenoid, the movable contact arm moves to the closed position, and current can flow through the circuit breaker 100.

When the circuit breaker mechanism 140 is in the off position and the lever 175 is in the on position (State D), the movable contact lever 175 is in the first open position 300, and current cannot flow through the circuit breaker 100.

From State D, if the circuit breaker mechanism 140 is toggled, e.g. by resetting the circuit breaker mechanism, the movable contact lever 175 moves to the closed position, and current can flow through the circuit breaker 100.

From State D, if the lever 175 is toggled, e.g. by remotely activating an actuation solenoid, the movable contact arm moves to the first open position 300, and current still cannot flow through the circuit breaker 100.

Figure 5:
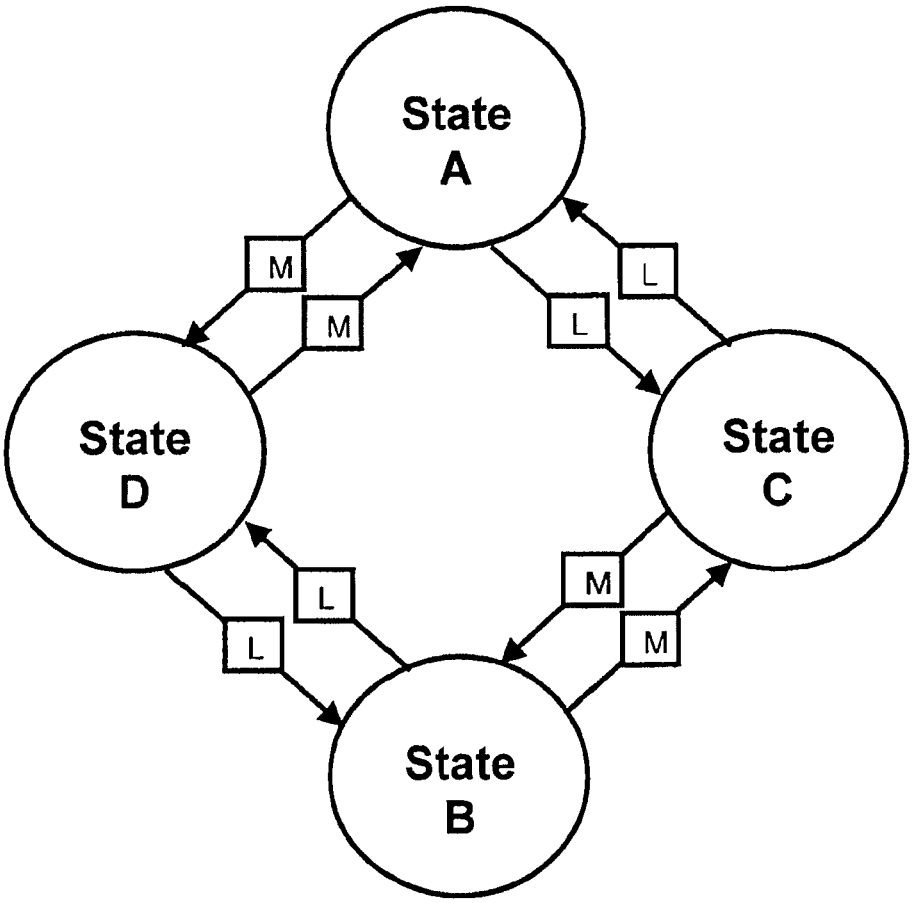
FIG. 5 is a state diagram reflecting various state transitions possible for the example circuit breaker shown in FIGS. 1-3 according to aspects of the invention.

FIG. 5 is a state diagram illustrating the different state transitions possible according to an example implementation of the invention, and as reflected in the table of FIG. 4. The only state which allows current to flow through the circuit breaker is State A. It is clear from the state diagram that it is impossible to transition directly from State B to State A without first passing through either State D or State C. Thus, State B can be thought of as a safety state of the circuit breaker 100.

A transition to State A from State D is controlled by the circuit breaker mechanism 140, e.g., the local operator who can reset the mechanism. A remote operator can initiate a transition from State B to State A only by encountering State D, which is controlled by the local operator.

Similarly, a transition to State A from State C is controlled by a lever operator, e.g., a remote operator actuating the lever 175 using solenoid 180. A local operator can initiate a transition from State B to State A only by encountering State C, which is controlled by the remote operator.

In this way, the circuit breaker 100 can be configured to provide an added layer of safety by requiring logical agreement between the operators of the circuit breaker 100 before energizing a protected circuit.

Although the invention has been described with reference to a particular arrangement of parts, features and the like, these are not intended to exhaust all possible arrangements or features, and indeed many modifications and variations will be ascertainable to those of skill in the art.

What is claimed is:

1. A circuit breaker comprising:

a first contact;

a second contact moveable between a closed position and an open position relative to the first contact, where the second contact is electrically connected to the first contact only in the closed position;

a unitary contact arm and lever assembly having a first end on which said second contact is mounted, a second end and a pivot point located between the first end and the second end;

an actuator having a first position and a second position and directly acting on the second end of said unitary contact arm and lever assembly, said actuator moving said unitary contact arm and lever assembly solely about the pivot point when moved from the first to the second position putting said second contact in the open position;

said circuit breaker further including a circuit breaker linkage having a tripped state and an untripped state, said circuit breaker linkage changes the position of the second contact when the circuit breaker linkage changes state;

a fault detector connected to said circuit breaker linkage, said fault detector causing said circuit breaker linkage to move from the untripped state to the tripped state in response to a sensed overcurrent;

wherein said circuit breaker linkage remains in the untripped state when the actuator moves from the first position to the second position;

wherein said actuator moves between the first position and the second position in response to a remote command signal;

wherein the remote command signal is independent from the sensed overcurrent; and wherein the actuator is a solenoid comprising a permanent magnet disposed to bias the contacts.

2. The circuit breaker of claim 1, wherein when the circuit breaker linkage is in the tripped state, the second contact is in the open position.

3. The circuit breaker of claim 2, wherein when the circuit breaker linkage is in the tripped state, said actuator cannot move the second contact to the closed position.

4. The circuit breaker of claim 1, further including a handle having an on and an off position, said handle operably connected to the circuit breaker linkage.

5. The circuit breaker of claim 4, wherein the handle is disposed to move the contacts from the closed position to the open position in response to a manual operation.

6. The circuit breaker of claim 4, wherein the handle remains in the on position when the actuator moves from the first position to the second position.

7. The circuit breaker of claim 1, wherein the contacts are biased using a spring.

8. A circuit breaker comprising:

a first contact;

a second contact moveable between a closed position and an open position relative to the first contact, where the second contact is electrically connected to the first contact only in the closed position;

a unitary contact arm and lever assembly having a first end on which said second contact is mounted, a second end and a pivot point located between the first end and the second end;

an actuator having a first position and a second position and directly acting on the second end of said unitary contact arm and lever assembly, said actuator moving said unitary contact arm and lever assembly solely about the pivot point when moved from the first to the second position putting said second contact in the open position;

said circuit breaker further including a circuit breaker linkage mechanism having a tripped state and an untripped state, said circuit breaker linkage mechanism changes the position of the second contact when the circuit breaker linkage mechanism changes state;

wherein said circuit breaker linkage mechanism remains in the untripped state when the actuator moves from the first position to the second position; and wherein the actuator is a solenoid that comprises a permanent magnet disposed to bias the contacts.

9. The circuit breaker of claim 8, wherein when the circuit breaker linkage mechanism is in the tripped state, the second contact is in the open position.

10. The circuit breaker of claim 9, wherein when the circuit breaker linkage mechanism is in the tripped state, said actuator cannot move the second contact to the closed position.

11. The circuit breaker of claim 8, wherein the circuit breaker linkage mechanism is disposed to move the contacts from the closed position to the open position in response to an overcurrent condition.

12. The circuit breaker of claim 8, further including a handle having an on and an off position, said handle operably connected to the circuit breaker linkage mechanism.

13. The circuit breaker of claim 12, wherein the handle is disposed to move the contacts from the closed position to the open position in response to a manual operation.

14. The circuit breaker of claim 12, wherein the handle remains in the on position when the actuator moves from the first position to the second position.

15. The circuit breaker of claim 8, wherein the contacts are biased using a spring.

16. The circuit breaker of claim 1, wherein said circuit breaker linkage does not move when the actuator moves from the first position to the second position.

* * * * *